US009594351B2

(12) United States Patent
Goeller et al.

(10) Patent No.: US 9,594,351 B2
(45) Date of Patent: Mar. 14, 2017

(54) MOON PHASE DISPLAY MECHANISM FOR TIMEPIECES

(71) Applicant: Montres Breguet S.A., L'Abbaye (CH)

(72) Inventors: Eric Goeller, Colombier (CH); Alain Zaugg, Le Sentier (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 15/085,178

(22) Filed: Mar. 30, 2016

(65) Prior Publication Data

US 2016/0349705 A1 Dec. 1, 2016

(30) Foreign Application Priority Data

May 27, 2015 (EP) ..... 15169454

(51) Int. Cl.
*G04B 19/26* (2006.01)
*G04B 19/253* (2006.01)

(52) U.S. Cl.
CPC ..... *G04B 19/268* (2013.01); *G04B 19/253* (2013.01)

(58) Field of Classification Search
CPC ..... G04B 19/268; G04B 19/26; G04B 19/24; G04B 19/247; G04B 19/253
See application file for complete search history.

(56) References Cited

U.S. PATENT DOCUMENTS 6,912,180 B2 * 6/2005 Dias ..... G04B 19/2536 368/28
2006/0221771 A1 * 10/2006 Zimmermann ..... G04B 19/268 368/16
2009/0274010 A1 * 11/2009 Vuilleumier ..... G04B 19/268 368/18
2011/0292768 A1 12/2011 Montet et al.
2012/0243382 A1 * 9/2012 Goeller ..... G04B 19/2536 368/38
2014/0247699 A1 9/2014 Sembritzki et al.

FOREIGN PATENT DOCUMENTS

EP 2 392 976 A2 12/2011
WO WO 2011/113170 A1 9/2011

OTHER PUBLICATIONS

European Search Report issued Jan. 20, 2016 in European application 15169454.4, filed on May 27, 2015 (with English Translation).

* cited by examiner

*Primary Examiner* — Sean Kayes
(74) *Attorney, Agent, or Firm* — Oblon, McClelland, Maier & Neustadt, L.L.P.

(57) ABSTRACT

Moon phase display mechanism including a control wheel driven by a movement, which control wheel drives a moon phase disc behind an aperture in a dial, and this mechanism includes: coaxial, superposed and permanently driven in opposite directions, a first phase indicator wheel carrying a first heart cam, and a second phase indicator wheel carrying a second heart cam, and this control wheel includes means for guiding a double lever comprising two arms, only one of which arms is arranged, at any time, to cooperate in contact with one of these second and first heart cams, each to display the moon phase visible in either the Northern or Southern Hemisphere, and to allow the moon phase disc to pivot in the appropriate direction for this hemisphere.

8 Claims, 6 Drawing Sheets

MOON PHASE DISPLAY MECHANISM FOR TIMEPIECES

This application claims priority from European Patent Application No. 15169454.4 filed on May 27, 2015, the entire disclosure of which is hereby incorporated herein by reference.

FIELD OF THE INVENTION

The invention concerns a moon phase display mechanism comprising a control wheel driven by a movement, which drives a moon phase disc behind an aperture in a dial.

The invention also concerns a watch or timepiece including a movement.

The invention concerns the field of complications for timepieces, in particular astronomical complications.

BACKGROUND OF THE INVENTION

The moon phase display is a prized complication in horology.

However, known mechanisms do not take proper account of the correct display valid both in the Northern Hemisphere and the Southern Hemisphere. Indeed, the crescent visible in one hemisphere does not correspond to that of the other hemisphere, but to its mirror image. It is difficult to interpret a double moon correctly.

WO Patent 2011/113170, in the name of BVLGARI ROTH & GENTA, discloses a retrograde moon phase display mechanism with a double heart-shaped cam, each heart-piece corresponding to one of the moon cycles, so that the phase indicator wheel is moved in opposite directions during the waxing and waning moon phases.

EP Patent 2392976, in the name of AUDEMARS PIGUET, discloses a quite complex mechanism for a more detailed moon phase display than known mechanisms, which requires stacking discs on three levels and very special components, which, in the case of an enamelled dial and discs, requires new tools and the management of additional components. This mechanism can be adapted to either hemisphere through the use of particular discs, which are mounted when the watch is assembled, but it cannot instantaneously switch the moon phase display to match the vision from one hemisphere or the other.

U.S. Patent 2014/247699, in the name of TIMEX, discloses a known mechanism devised to simultaneously or selectively display moon phases in the Northern and/or Southern Hemisphere, for an electronic watch.

SUMMARY OF THE INVENTION

The invention proposes to provide an immediate reading, requiring no interpretation, for an observer in the Northern Hemisphere or for an observer in the Southern Hemisphere, by means of a simple mechanism which is compact, particularly in thickness, and can keep and change at will one of the positions. The invention is economical, as it utilises ordinary dials and discs, and does not require the creation of additional display components, and the moon disc control mechanism of the invention is devised to be easily incorporated in a mechanism with an ordinary moon wheel. The invention preferably employs a conventional control means, such as, for example, a GMT or similar control means, which can easily be reutilised in this particular application, to drive a shuttle which, with no other action, causes the moon disc to rotate so that it is viewed in the selected hemisphere.

To this end, the invention concerns a moon phase display mechanism comprising a control wheel driven by a movement, which drives a moon phase disc behind an aperture in a dial, according to claim 1.

The invention also concerns a watch or timepiece including such a movement, according to claim 6.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
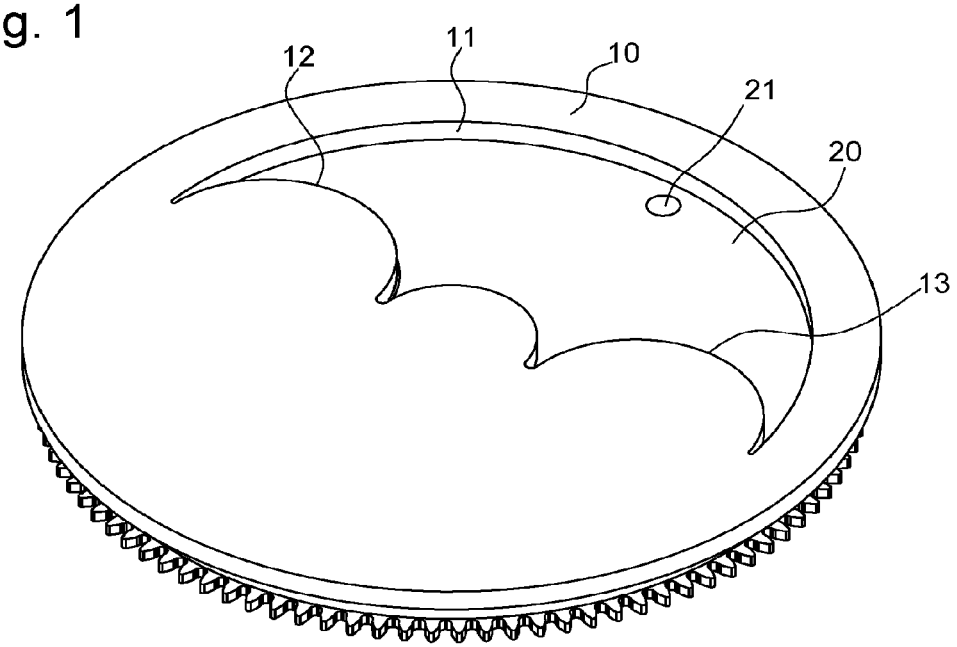
FIG. 1 shows a schematic perspective top view, as seen by the user, of the mechanism according to the invention.
Figure 2:
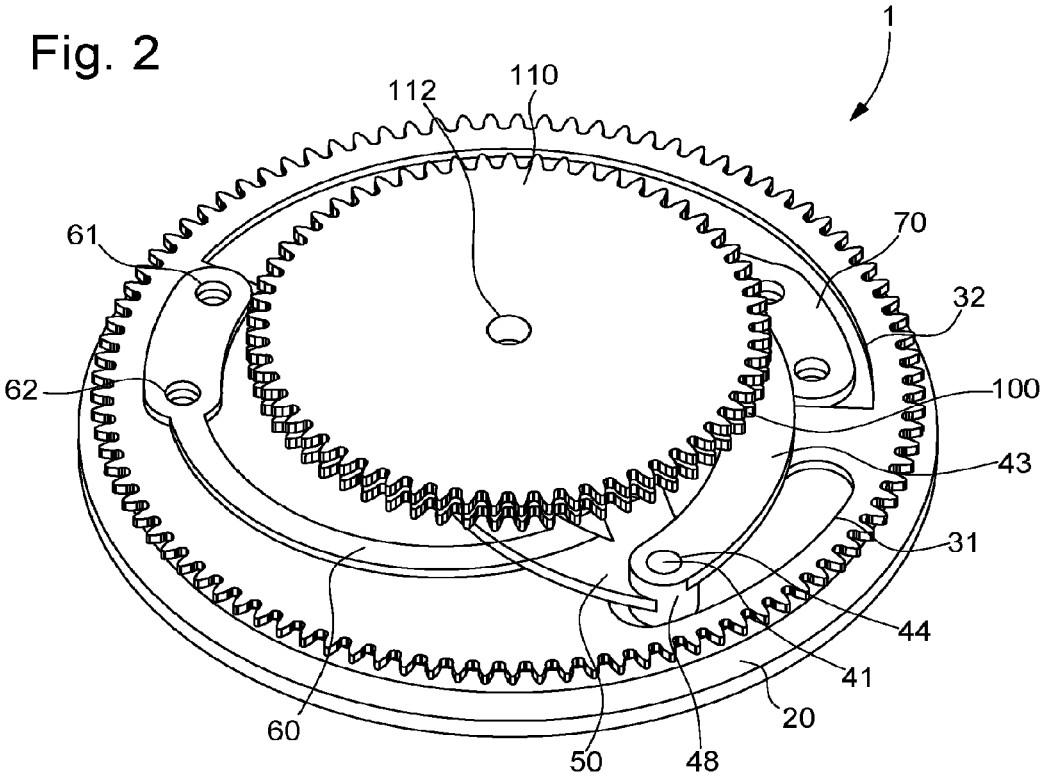
FIG. 2 shows, in a similar manner, the same mechanism seen from below.
Figure 3:
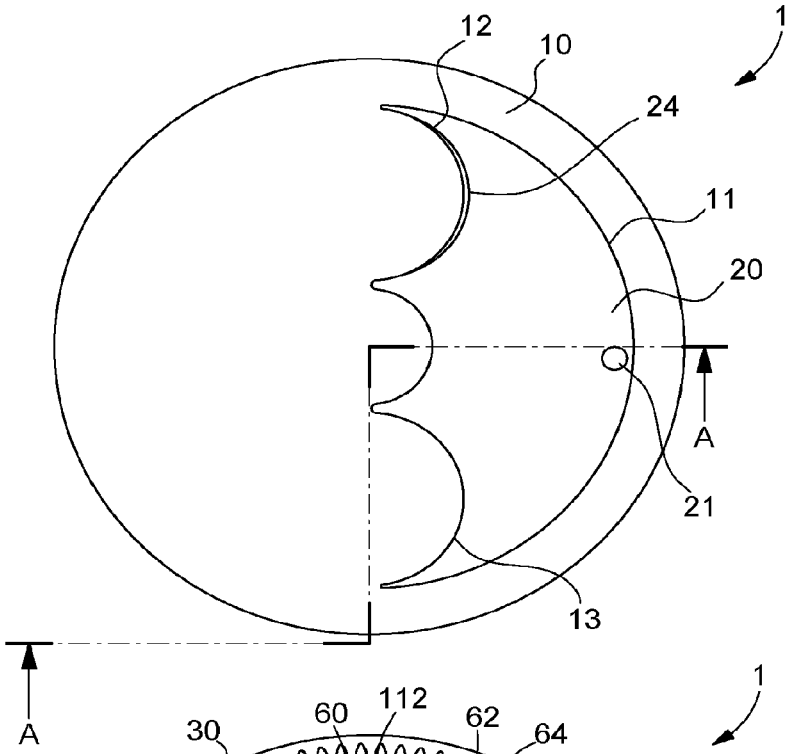
FIG. 3 is a plan view, from above, corresponding to FIG. 1.
Figure 4:
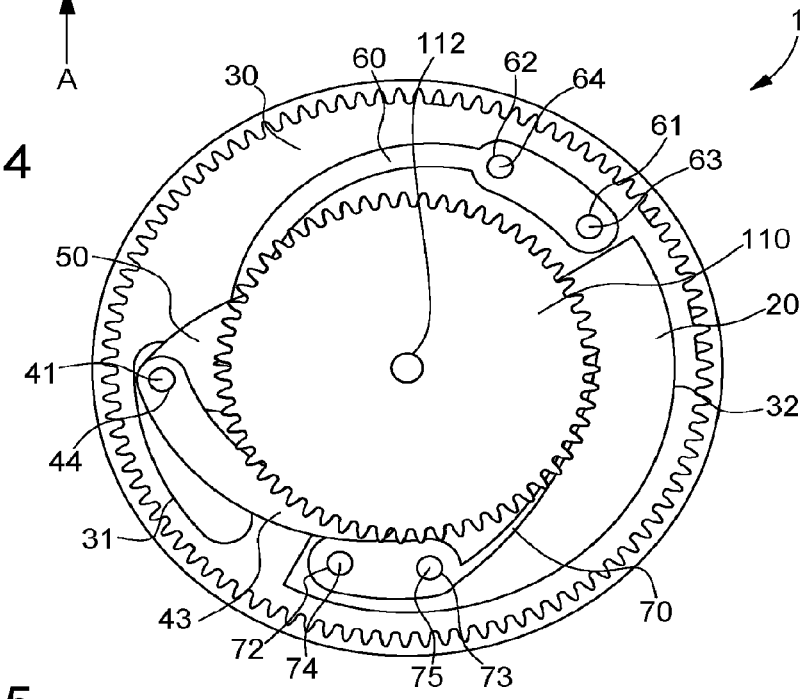
FIG. 4 is a plan view, from below, corresponding to FIG. 2.
Figure 5:
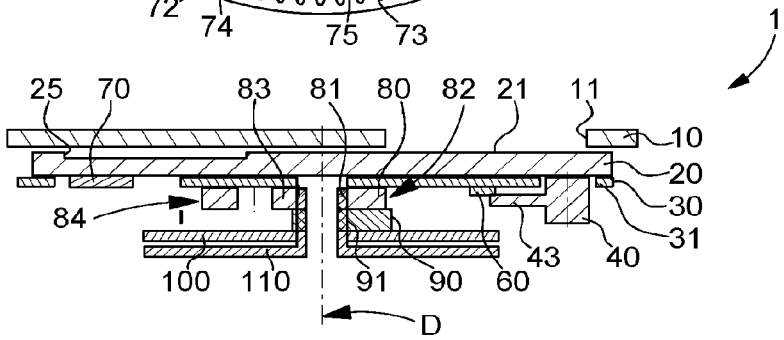
FIG. 5 is a cross-section along the line AA of FIG. 3.
Figure 6:
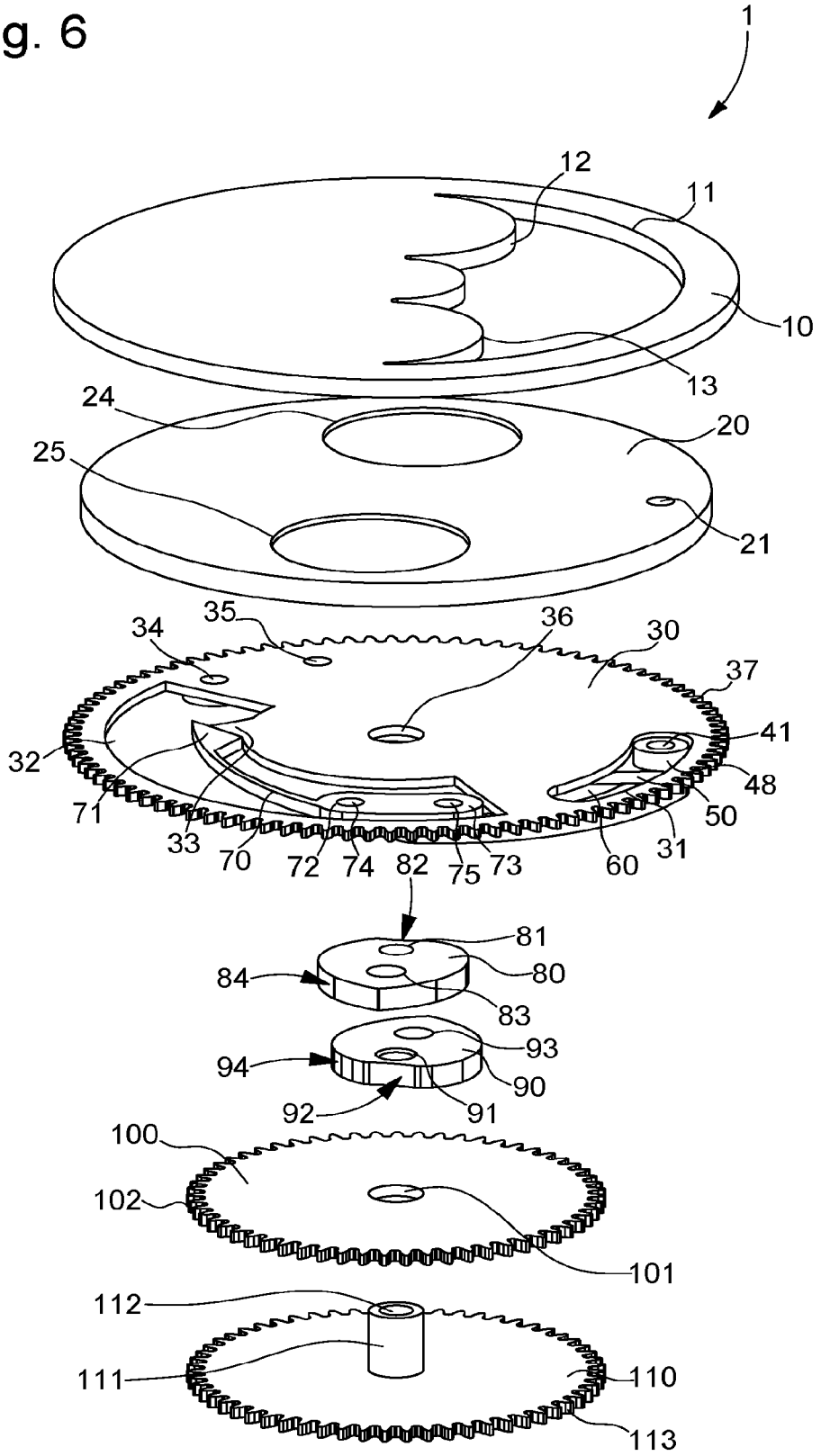
FIG. 6 is an exploded perspective top view, corresponding to FIG. 1.
Figure 7:
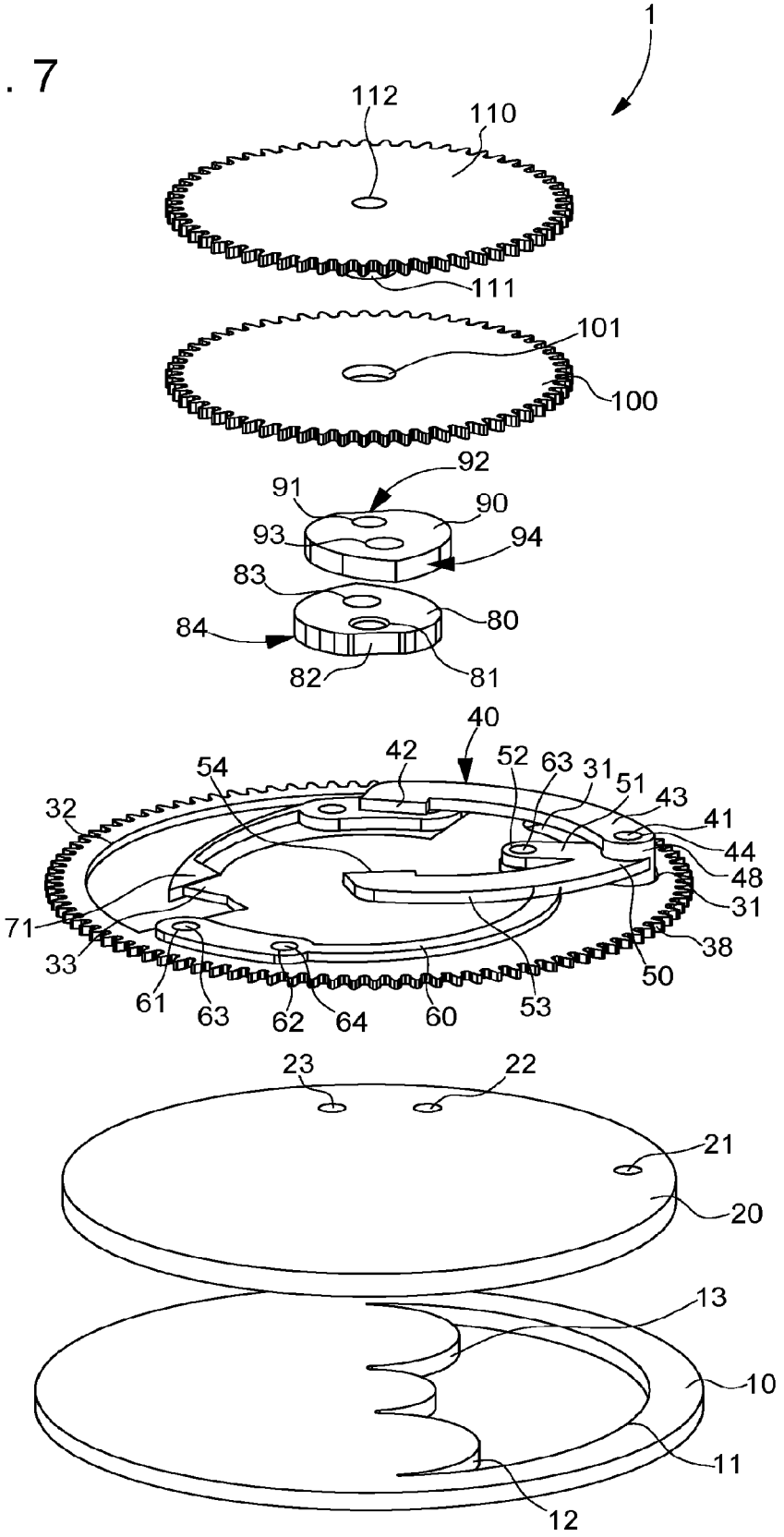
FIG. 7 is an exploded perspective bottom view corresponding to FIG. 2.
Figure 8:
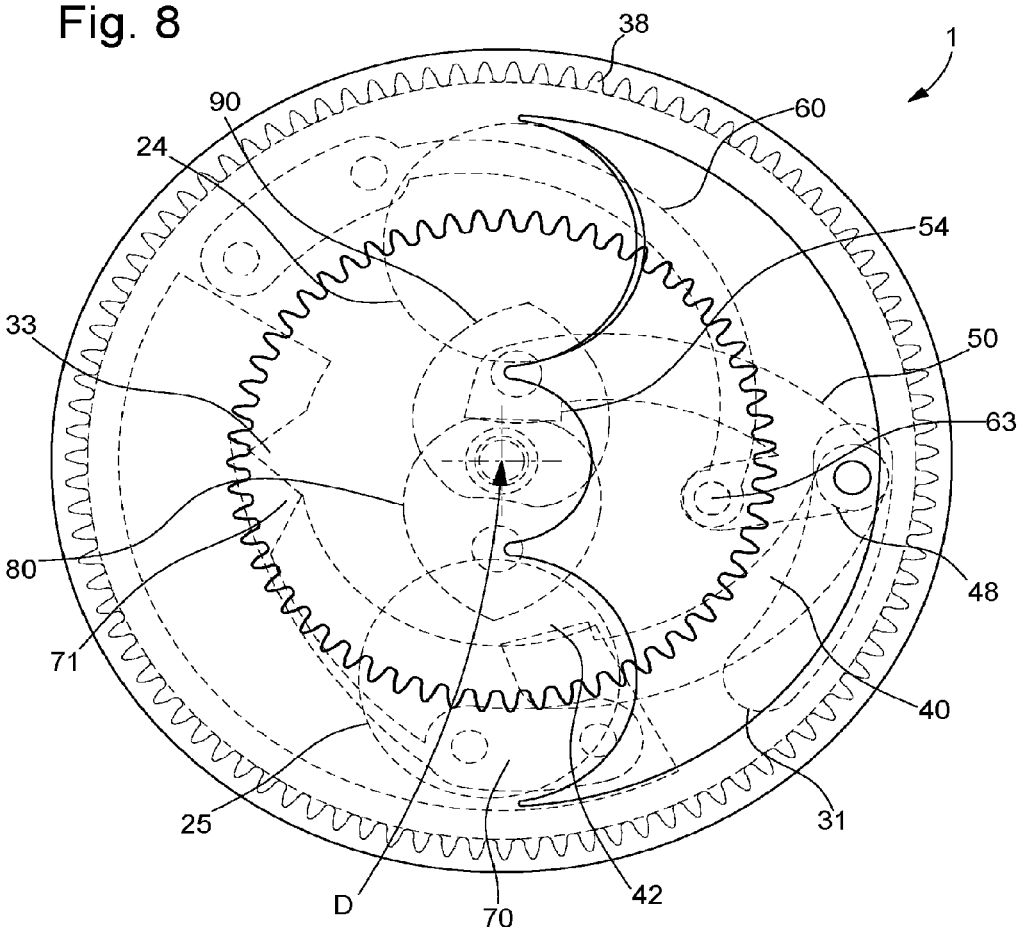
FIG. 8 is a bottom view showing the concealed parts of the mechanism, not visible in the other Figures, and showing the cooperation of one arm of a double lever with a heart cam.
Figure 9:
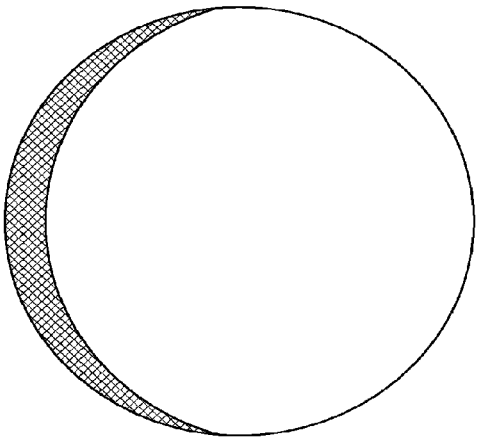
FIG. 9 shows the moon as seen by an observer at a given moment in the Northern Hemisphere.
Figure 10:
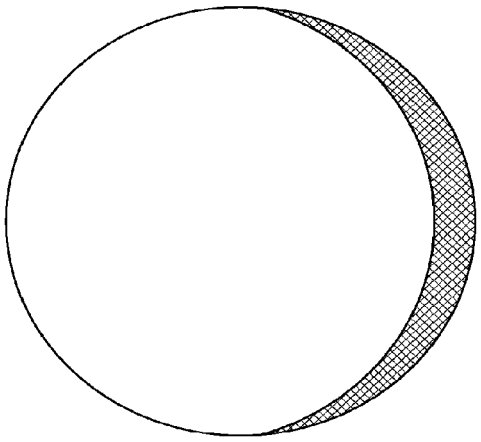
FIG. 10 shows it as seen, at the same moment, in the Southern Hemisphere.

The invention concerns a moon phase display mechanism 1 for a watch or timepiece.

In a known manner, the complete display mechanism includes a conventional drive wheel, called a moon wheel (generally with 59 teeth), which operates in steps or continuously (not shown in the Figures) and is arranged to drive two phase indicator wheels 100 and 110, which turn in opposite directions to each other, owing to the addition of an intermediate wheel (not shown) for driving one of these two wheels 100, 110.

Each of the two phase indicator wheels 100 and 110 carries a cam, respectively 90, 80, for returning to zero. Advantageously, and as shown in the Figures, these cams 80, 90 are heart-cams similar to those used in a chronograph or time zone change mechanism.

According to the invention the moon phase display mechanism 1 thus includes, coaxial along a common pivot axis D and superposed on each other:

- a first phase indicator wheel 110 carrying a first heart cam 80 by means of a pipe 111;

a second moon phase indicator wheel 100, including a bore 101 through which pipe 111 passes, and directly carrying a second heart cam 90.

Moon phase indicator mechanism 1 also includes, centered on the same axis D:

a control wheel 30 driven by a movement 900 and carrying a set of levers arranged to cooperate with cams 80 and 90;

a moon phase disc 20 pivotally driven by control wheel 30;

a moon phase display dial 10 comprising an aperture 11 behind which moon phase disc 20 moves.

Control wheel 30 is connected alternately, by a double lever 40, to two feelers or rollers, to take information alternately from one or other of the two cams 80 or 90, namely North or South.

According to the invention, this control wheel 30 includes means 31 for guiding this double lever 40 comprising two arms 43, 53, only one of which is arranged, at any time, to cooperate in contact with one of these second 90 and first 80 heart cams. Each heart cam 80, 90, is arranged to display the moon phase visible in either the Northern or Southern Hemisphere, and to allow the moon phase disc 20 to pivot in the appropriate direction for this hemisphere.

The change of hemisphere is controlled by the action of a control means 500 in order to pivot the control wheel 30, which is a free wheel, but held elastically by a first spring 70 and secured to the moon phase disc 20. This first spring 70 includes a finger 71 arranged to catch a beak 33 of the control wheel 30.

More particularly the change of hemisphere is achieved by control wheel 30 which operates as a free wheel, but is held elastically by a first spring 70 positioned and secured by pins 74, 75, or suchlike, underneath moon phase disc 20. This first spring 70 has restricted mobility inside a cut-out 32 of control wheel 30, and it includes a finger 71, arranged to catch a beak 33 of control wheel 30.

More particularly control wheel 30 includes an oblong, preferably annular hole, forming said means 31 for guiding this double lever 40, around axis D, inside which moves a trunnion 48 comprised in double lever 40. A bore 44 in trunnion 48 guides a pin 41 or similar, which is secured to moon phase disc 20 in a bore 21.

The relative pivoting motion between control wheel 30 and moon phase disc 20 is therefore limited by the travel of trunnion 48 in oblong hole 31.

Double lever 40 includes, on two different parallel planes:

a lower arm 43, carrying a hammer 42, which is arranged to cooperate with the second heart cam 90;

an upper arm 53 carrying a hammer 54, which is arranged to cooperate with first heart cam 80.

This double lever 40 also includes a return arm 51, articulated by an arbor 63 at the end of a second spring 60 which is secured to control wheel 30, here by pins 63, 64 or similar.

At any given moment, moon phase display mechanism 1 provides the moon display in only one hemisphere, which spares the user any interpretation.

Figure 11:
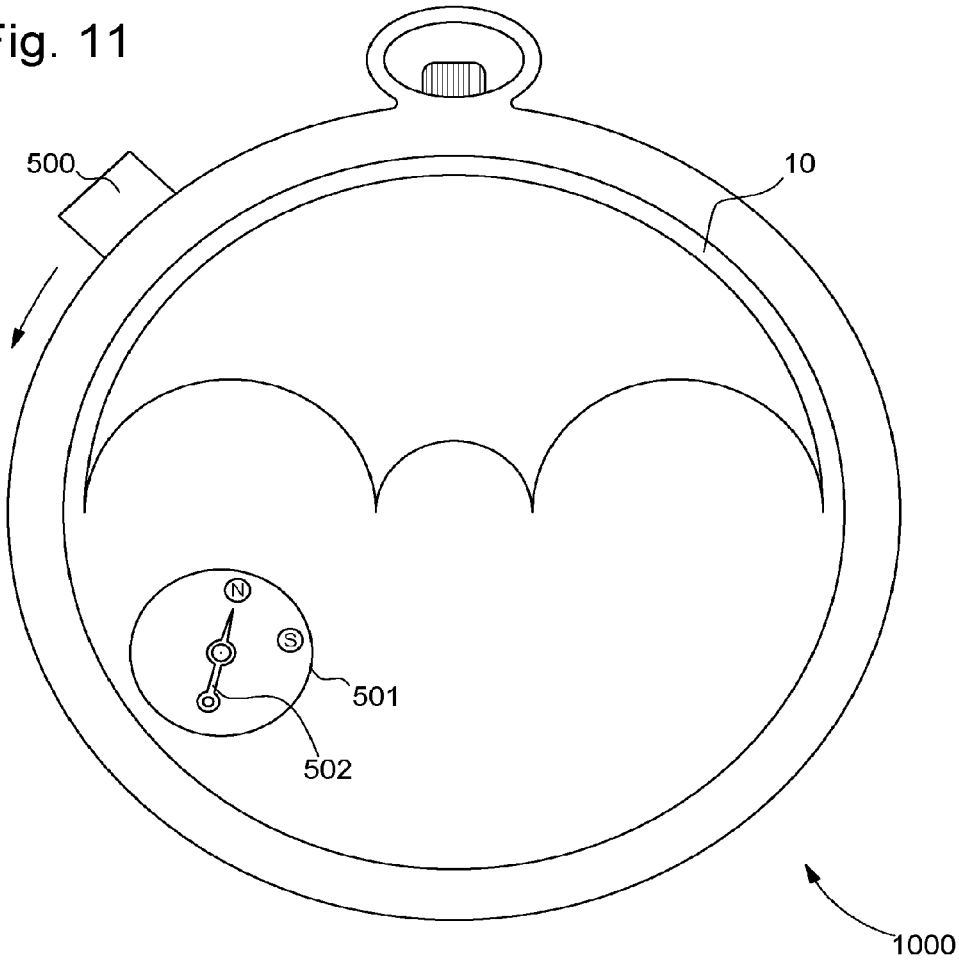
FIG. 11 shows a schematic face view of a watch including a mechanism according to the invention, and including a separate display indicating the hemisphere in which the moon is displayed.
Figure 12:
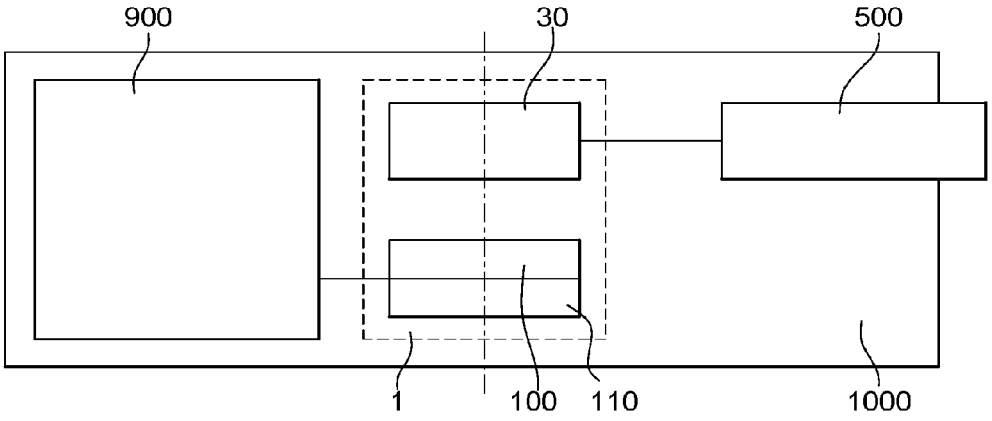
FIG. 12 is a block diagram showing such a watch, including a movement and a control means which both cooperate with a mechanism according to the invention.

The user can summon the other hemisphere by means of a conventional control means 500, such as a push-piece, a pull-out piece, or suchlike, and each time mechanism 1 remains immobile in the new position: the Northern or Southern Hemisphere. Preferably, this control means 500 is actuated against an elastic return means such as a spring, and a shuttle operated by the control means is immobilised by reversible locking means, in the manner of a ballpoint pen. Thus, advantageously, in a known manner, the hemisphere selection control circuit can also indicate, by means of a separate display, the hemisphere in which the moon phase is currently displayed following operation of control means 500. FIG. 11 illustrates a non-limiting example in which a hand 502 indicates, in an aperture 501, the presence of a moon phase in the Northern or Southern Hemisphere.

Action on control means 500 causes control wheel 30 to pivot. It is understood that this action on control means 500 is reversible: two successive actions on control means 500 have the effect of pivoting control wheel 30 in two opposite directions.

In the rest position of mechanism 1, i.e. when it is not actuated, the selection of a given hemisphere is made, and the combination of means described above is such that one of hammers 42, 54 of double lever 40 is and remains bearing on a flat portion 82, 92, comprised in the heart-piece 80, 90 concerned. Further, since the first phase indicator wheel 110 or the second phase indicator wheel 100 is driven by the moon wheel, driven by a timepiece movement 900, a torque can be exerted on double lever 40, so that trunnion 48 is kept bearing at one end of oblong hole 31 of control wheel 30. Finger 71 of first spring 70 is then stopped on a first side of beak 33 of control wheel 30. The moon phase disc 20 is then driven, with no play, in a first pivoting direction.

When control means 500 is actuated by the user, the action has the effect of imparting a pivoting motion on control wheel 30 in the opposite direction to the preceding direction, and trunnion 48 is shifted to the other end of oblong hole 31, which has the effect of pivoting double lever 40 against second spring 60 which, until then, was holding it in position on one of heart-pieces 80, 90, so that the other hammer 54, 42, then bears on the other heart-piece 90, 80, finds contact with its flat portion 92, 82 and then drives control wheel 30 in the opposite direction, causing first spring 70 to jump, finger 71 of first spring 70 passes over beak 33 and then remains bearing on a second side of the latter. Control wheel 30 then regularly pivots moon phase disc 20 in the opposite direction, after the position has been caught up.

A subsequent action on control means 500 starts the operation in reverse.

Display mechanism 1 according to the invention is particularly stable, without requiring any particular friction surface: the torque provided by movement 900 to the moon wheel is sufficiently high to ensure that one of arms 43, 53 of double lever 40 is permanently driven by the corresponding heart-piece 80, 90, and the thrust force transmitted to control wheel 30 by the control means makes it possible to pass the notch corresponding to finger 71 passing over beak 33.

In short, this simple, compact mechanism offers a new and advantageous functionality for the user. It is driven in a conventional manner by a moon wheel, and can easily replace any ordinary moon phase display mechanism, the only important modification consists in fitting out a watch 1000, which incorporates movement 900 and mechanism 1, by incorporating control means 500, such as, for example, those used for a GMT time zone change mechanism.

The invention still concerns a watch 1000 or timepiece comprising a movement 900, this movement 900 being arranged to permanently drive in opposite directions a such first phase indicator wheel 110 and a such second phase indicator wheel 100. And this watch 1000 includes a control means 500 arranged to pivot the control wheel 30 to control the change of moon display in the Northern or Southern Hemisphere.

More particularly this control means 500 is arranged such that the mechanism 1 remains, after each operation of control means 500, immobilised in the new position reached, and control means 500 is actuated against an elastic return means, and a shuttle controlled by such control means 500 is immobilised by reversible locking means.

More particularly watch 1000 includes a separate display for identification of the Northern or Southern Hemisphere in which the moon phase is currently displayed following actuation of control means 500.

What is claimed is:

1. A moon phase display mechanism comprising a control wheel driven by a movement, which control wheel drives a moon phase disc behind an aperture in a dial, wherein said mechanism includes: coaxial, superposed and permanently driven in opposite directions, a first phase indicator wheel carrying a first heart cam, and a second phase indicator wheel carrying a second heart cam and said control wheel includes means for guiding a double lever comprising two arms only one of which is arranged, at any time, to cooperate in contact with one of said second and first heart cams, each heart cam being arranged to display the moon phase visible in either the northern or southern hemisphere, and to allow said moon phase disc to pivot in the appropriate direction for said hemisphere.

2. The moon phase display mechanism according to claim 1, wherein the change of hemisphere is controlled by the action of a control means in order to pivot said control wheel, which is a free wheel, but held elastically by a first spring and secured to said moon phase disc, said first spring includes a finger arranged to catch a beak of said control wheel.

3. The moon phase display mechanism according to claim 1, wherein said guide means consist of an oblong hole in which is movable a trunnion comprised in said double lever, said trunnion guides a pin which is secured to said moon phase disc for the driving thereof.

4. The moon phase display mechanism according to claim 1, wherein said double lever includes, on two different parallel planes, a lower arm, carrying a hammer, arranged to cooperate with said second heart cam, and an upper arm, carrying a hammer, arranged to cooperate with said first heart cam, said double lever also including a return arm articulated at the end of a second spring secured to said control wheel.

5. The moon phase display mechanism according to claim 1, wherein said first phase indicator wheel carries said first heart cam by means of a pipe which passes through said second phase indicator wheel, which directly carries said second heart cam, which is arranged in a different plane from that of said first heart cam.

6. A watch or timepiece comprising a display mechanism according to claim 1 wherein said movement is arranged to permanently drive in opposite directions said first phase indicator wheel and said second phase indicator wheel, and in that said watch includes a control means arranged to pivot said control wheel to control the change of moon display in the Northern or Southern Hemisphere.

7. The watch according to claim 6, wherein said control means is arranged such that said mechanism remains, after each operation of said control means, immobilised in the new position reached, and in that said control means is actuated against an elastic return means, and in that a shuttle controlled by said control means is immobilised by reversible locking means.

8. The watch according to claim 7, wherein said watch includes a separate display for identification of the Northern or Southern Hemisphere in which the moon phase is currently displayed following actuation of said control means.

* * * * *